United States Patent [19]

Zinsmeyer

[11] Patent Number: 4,539,820

[45] Date of Patent: Sep. 10, 1985

[54] PROTECTIVE CAPACITY CONTROL SYSTEM FOR A REFRIGERATION SYSTEM

[75] Inventor: Thomas M. Zinsmeyer, Pennellville, N.Y.

[73] Assignee: Carrier Corporation, Syracuse, N.Y.

[21] Appl. No.: 610,159

[22] Filed: May 14, 1984

[51] Int. Cl.[3] ..... F25D 17/02

[52] U.S. Cl. ..... 62/201; 62/217

[58] Field of Search ..... 62/217, 226, 227, 201, 62/185, 157, 231, 215, 228.5, 98, 99; 165/12; 318/599; 236/46 R, 46 F, 1 E, 76, 78 D

[56] References Cited

U.S. PATENT DOCUMENTS

| | | | |
|---|---|---|---|
| 3,081,604 | 3/1963 | Namisniak et al. | 62/84 |
| 3,204,423 | 9/1965 | Resh, Jr. | 62/215 |
| 3,493,167 | 2/1970 | Akerhielm et al. | 230/4 |
| 3,625,628 | 12/1971 | Byrns | 415/150 |
| 3,703,183 | 11/1972 | Worthen | 137/47 |
| 3,751,940 | 8/1973 | Norbeck | 62/217 |
| 3,780,532 | 12/1973 | Norbeck et al. | 62/226 X |
| 4,068,980 | 11/1978 | Fine et al. | 417/282 |
| 4,199,023 | 4/1980 | Phillips | 165/12 |
| 4,201,061 | 5/1980 | Heffernan | 62/98 |
| 4,330,999 | 5/1982 | Nakayama | 62/217 |
| 4,407,139 | 10/1983 | Ide et al. | 62/215 |

*Primary Examiner*—Harry Tanner

*Attorney, Agent, or Firm*—Douglas L. Miller

[57] ABSTRACT

A protective capacity control system and method for controlling the capacity of a refrigeration system are disclosed. The protective capacity control system receives electrical input signals indicative of operator selected settings and refrigeration system operating parameters. These input signals are processed to generate a control signal which is a step function, preferably having two steps, of the temperature difference between a desired set point temperature and the sensed temperature of a heat transfer fluid cooled by operation of the refrigeration system. The capacity of the refrigeration system is reduced at a first effective overall rate to provide capacity control which will reduce hunting by the capacity control system when the sensed temperature of the heat transfer fluid cooled by operation of the refrigeration system is less than a lower limit of a selected temperature deadband relative to the desired set point temperature. The capacity of the refrigeration system is reduced at a second effective overall rate, greater than the first effective overall rate, when the sensed temperature of the heat transfer fluid cooled by operation of the refrigeration system is less than a second, predetermined temperature limit which is less than the lower limit of the selected temperature deadband relative to the set point temperature to prevent freezing of the heat transfer fluid cooled by operation of the refrigeration system.

4 Claims, 2 Drawing Figures

PROTECTIVE CAPACITY CONTROL SYSTEM FOR A REFRIGERATION SYSTEM

BACKGROUND OF THE INVENTION

The present invention relates to methods of operating and control systems for refrigeration systems and, more particularly, to methods of operating and control systems for capcity control devices, such as compressor inlet guide vanes, in centrifugal vapor compression refrigeration systems.

Generally, refrigeration systems include an evaporator or cooler, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water which is circulated to a remote location to satisfy a refrigeration load. The refrigerant in the evaporator evaporates as it absorbs heat from the water flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

To maximize operating efficiency, it is desirable to match the amount of work done by the compressor to the work needed to satisfy the refrigeration load placed on the refrigeration system. Commonly, this is done by capacity control means which adjust the amount of refrigerant vapor flowing through the compressor. The capacity control means may be a device such as guide vanes which are positioned between the compressor and the evaporator and which moves between a fully open and a fully closed position in response to the temperature of the chilled water leaving the chilled water coil in the evaporator. When the evaporator chilled water temperature falls, indicating a reduction in refrigeration load on the refrigeration system, the guide vanes move toward their closed position, decreasing the amount of refrigerant vapor flowing through the compressor. This decreases the amount of work that must be done by the compressor thereby decreasing the amount of energy needed to operate the refrigeration system. At the same time, this has the effect of increasing the temperature of the chilled water leaving the evaporator. In contrast, when the temperature of the leaving chilled water rises, indicating an increase in load on the refrigeration system, the guide vanes move toward their fully open position. This increases the amount of vapor flowing through the compressor and the compressor does more work thereby decreasing the temperature of the chilled water leaving the evaporator and allowing the refrigeration system to respond to the increased refrigeration load. In this manner, the compressor operates to maintain the temperature of the chilled water leaving the evaporator at, or within a certain range of, a set point temperature.

When the evaporator chilled water temperature decreases during the capacity control operating sequence described above, the guide vanes must be moved toward their fully closed position fast enough to provide a refrigeration system response which will prevent the evaporator chilled water temperature from falling below the freezing point of the water flowing through the tubes in the evaporator. This is necessary because water freezing in the tubes in the evaporator may block or break the tubes thereby possibly rendering the refrigeration system inoperable. Therefore, capacity control means for refrigeration systems are conventionally operated to drive the guide vanes toward their fully closed position at the maximum possible guide vane closing speed whenever the evaporator chilled water temperature falls below the evaporator chilled water set point temperature by a predetermined amount. No capacity control action is taken by these capacity control means before the evaporator chilled water temperature falls below the evaporator chilled water set point temperature by the predetermined amount. This is not particularly desirable since it may result in overcompensating for the decrease in the evaporator chilled water temperature thereby resulting in undesirable hunting about the evaporator chilled water set point temperature. However, this disadvantage is normally tolerated to ensure that there is no chance of the evaporator chilled water temperature falling below the freezing point of the water flowing through the tubes in the evaporator.

One control system, a model CP-8142-024 electronic chiller controller available from the Barber-Colman Company having a place of business in Rockfold, Ill., adjusts a capacity control device in a refrigeration system in a somewhat different manner than the conventional way described above. In this control system, when the evaporator chilled water temperature drops below the selected evaporator chilled water set point temperature by a predetermined amount, a capacity control device is continuously adjusted by an actuator which is continuously energized by a stream of electrical pulses supplied to the actuator. The predetermined amount of deviation before the actuator is continuously energized provides a temperature deadband in which the capacity control device is not adjusted. The pulse rate of the stream of electrical pulses supplied to the actuator determines the overall rate of adjustment of the capacity control device. This pulse rate may be set at either a minimum, middle, or maximum value thereby providing a limited capability for tailoring operation of the control system to meet specific job requirements of a particular job application for the refrigeration system. However, due to the operation of, and interrelationships among, the electrical components of the control system, the extent of the deadband depends on which pulse rate setting is selected. Also, the pulse rate is an analog function of the deviation of evaporator leaving chilled water temperature from the desired set point temperature thereby rendering this control system not particularly suitable with a microcomputer system for controlling overall operation, including capacity, of a refrigeration system.

SUMMARY OF THE INVENTION

Therefore, it is an object of the present invention to provide a simple, effficient, and effective protection capacity control system for preventing excessive cooling of a heat transfer fluid cooled by operation of the refrigeration system while providing capacity control for the refrigeration system when the temperature of the heat transfer fluid decreases below a heat transfer fluid set point temperature. It is another object of the present invention to provide a simple, efficient, and effective protective capacity control system having the features described above and which is suitable for use with a microcomputer system for controlling overall operation, including capacity, of a refrigeration system.

These and other objects of the present invention are attained by a capacity control system for a refrigeration system comprising a capacity control device for controlling refrigerant flow in the refrigeration system, a microcomputer, and means for generating first, second and third signals indicative of a selected set point temperature for a heat transfer fluid cooled by operation of the refrigeration system, a sensed temperature of the heat transfer fluid cooled by operation of the refrigeration system, and a selected temperature deadband relative to the selected set point temperature, respectively. The first, second and third signals are supplied to the microcomputer which determines the relative temperature difference between the sensed temperature of the heat transfer fluid cooled by operation of the refrigeration system and the selected set point temperature. When the sensed temperature of the heat transfer fluid is determined to be less than the selected set point temperature by an amount which exceeds the lower limit of the selected temperature deadband, the microcomputer generates a control signal which is a step function of the determined temperature difference. This step function is easily programmed into the microcomputer since the step function is a digital type function which is highly compatible with programming techniques for the micrcomputer. The capacity control device is adjusted to control refrigerant flow in the refrigeration system in response to the control signal generated by the microcomputer. By properly selecting the characteristics of the step function, the capacity control device may be adjusted in a first temperature deviation region so that operation of the refrigeration system is adjusted to compensate for the decrease in heat transfer fluid temperature without undesirable hunting by the capacity control system. Also, the capacity control system may be operated in a second temperature deviation region so that the capacity control device decreases the capacity of the refrigeration system at its maximum possible rate to effectively prevent undesirable freezing of the heat transfer fluid which is being cooled by operation of the refrigeration system.

BRIEF DESCRIPTION OF THE DRAWING

Still other objects and advantages of the present invention will be apparent from the following detailed description of the present invention in conjunction with the accompanying drawing in which.

DESCRIPTION OF THE PREFERRED EMBODIMENT

Figure 1:
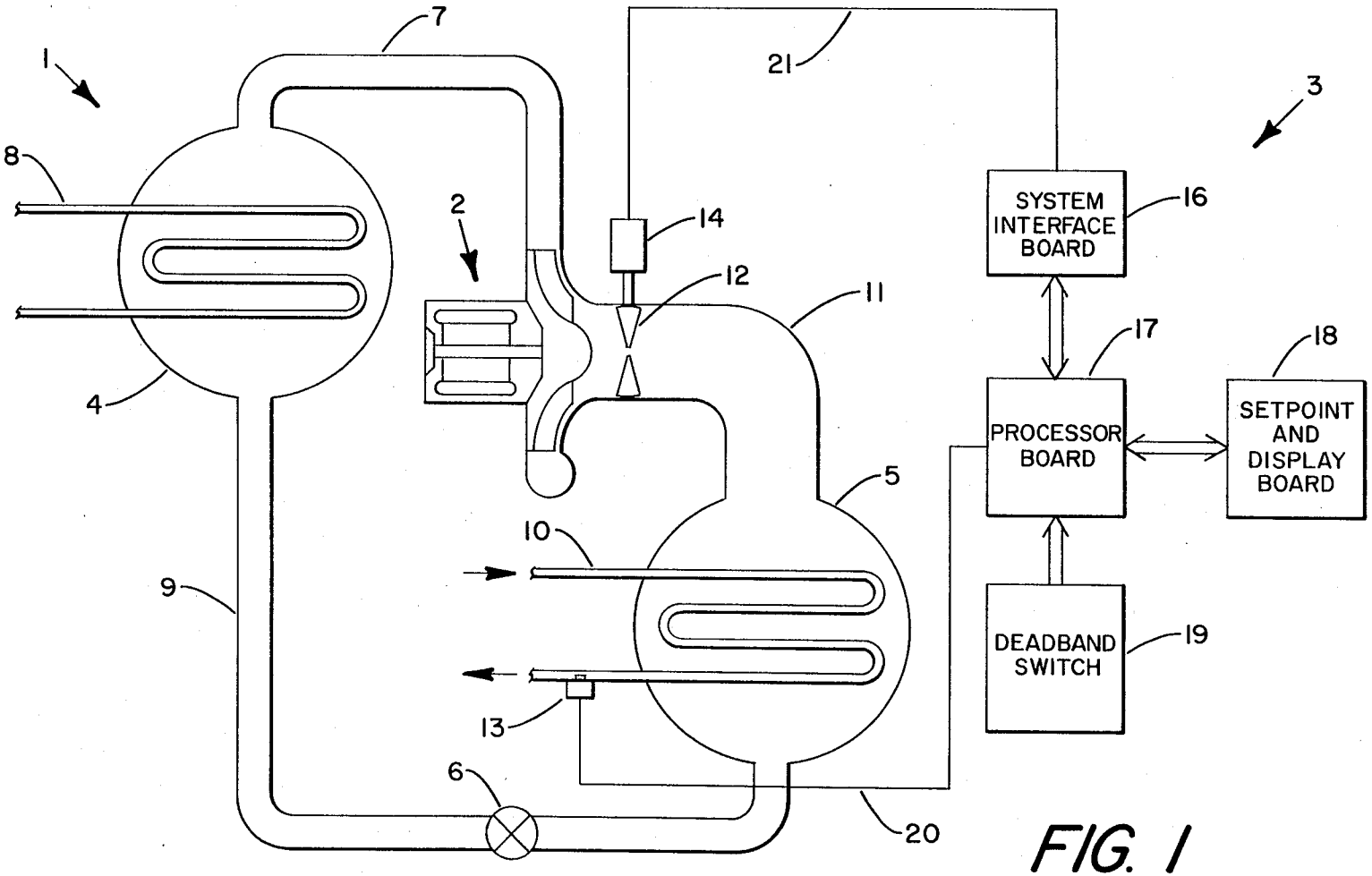
FIG. 1 is a schematic illustration of a centrifugal vapor compression refrigeration system with a control system for varying the capacity of the refrigeration system according to the principles of the present invention.

Referring to FIG. 1, a vapor compression refrigeration system 1 is shown having a centrifugal compressor 2 with a control system 3 for varying the capacity of the refrigeration system 1 according to the principles of the present invention. As shown in FIG. 1, the refrigeration system 1 includes a condenser 4, an evaporator 5 and an expansion valve 6. In operation, compressed gaseous refrigerant is discharged from the compressor 2 through compressor discharge line 7 to the condenser 4 wherein the gaseous refrigerant is condensed by relatively cool condensing water flowing through tubing 8 in the condenser 4. The condensed liquid refrigerant from the condenser 4 passes through the expansion valve 6 in refrigerant line 9 to evaporator 5. The liquid refrigerant in the evaporator 5 is evaporated to cool a heat transfer fluid, such as water, flowing through tubing 10 in the evaporator 5. This cool heat transfer fluid is used to cool a building or is used for other such purposes. The gaseous refrigerant from the evaporator 5 flows through compressor suction line 11 back to compressor 2 under the control of compressor inlet guide vanes 12. The gaseous refrigerant entering the compressor 2 through the guide vanes 12 is compressed by the compressor 2 and discharged from the compressor 2 through the compressor discharge line 7 to complete the refrigeration cycle. This refrigeration cycle is continuously repeated during normal operation of the refrigeration system 1.

The compressor inlet guide vanes 12 are opened and closed by a guide vane actuator 14 controlled by the capacity control system 3 which comprises a system interface board 16, a processor board 17, a set point and display board 18, and deadband switch 19. Also, a temperature sensor 13 for sensing the temperature of the heat transfer fluid leaving the evaporator 5 through the tubing 10, is connected by electrical lines 20 directly to the processor board 17.

Preferably, the temperature sensor 13 is a temperature responsive resistance device such as a thermistor having its sensing portion located in the heat transfer fluid leaving the evaporator 5 with its resistance monitored by the processor board 17, as shown in FIG. 1. Of course, as will be readily apparent to one of ordinary skill in the art to which the present invention pertains, the temperature sensor 13 may be any of a variety of temperature sensors suitable for generating a signal indicative of the temperature of the heat transfer fluid leaving the evaporator 5 and for supplying this generated signal to the processor board 17.

The processor board 17 may be any device, or combination of devices, capable of receiving a plurality of input signals, processing the received input signals according to preprogrammed procedures, and producing desired output control signals in response to the received and processed input signals, in a manner according to the principles of the present invention. For example, the processor board 17 may comprise a microcomputer, such as a model 8031 microcomputer available from Intel Corporation which has a place of business at Santa Clara, Calif.

Also, preferably, the deadband switch 19 is a "DIP" (Dual Inline Package) switch, such as a model 5-435166-3 DIP switch available from Amp, Inc. which has a place of business at Harrisburg, Pa. which is suitable for use with the processor board 17. However, this switch 19 may be any device capable of generating a suitable signal which is indicative of a selected setting and which is compatible with the processor board 17. Also, it should be noted that, although the switch 19 is shown as a separate component in FIG. 1, this switch 19 may be physically part of the processor board 17 in an actual capacity control system 3.

Further, preferably, the set point and display board 18 comprises a visual display, including, for example, light emitting diodes (LED's) or liquid crystal display (LCD's) devices forming a multi-digit display which is under the control of the processor board 17. Also, the set point and display board 18 includes a device, such as a set point potentiometer model AW 5403 available from CTS, Inc. which has a place of business at Skyland, N.C., which is adjustable to output a signal to the processor board 17 indicative of a selected set point temperature for the chilled water leaving the evaporator 5 through the evaporator chilled water tubing 10.

Still further, preferably, the system interface board 16 includes at least one switching device, such as a model SC-140 triac available from General Electric Company which has a place of business at Auburn, N.Y., which is used as a switching element for controlling a supply of electrical power (not shown) through electrical lines 21 to the guide vane actuator 14. The triac switches on the system interface board 16 are controlled in response to control signals received by the triac switches from the processor board 17. In this manner, electrical power is supplied through the electrical lines 21 to the guide vane actuator 14 under control of the processor board 17 to operate the guide vane actuator 14 in the manner according to the principles of the present invention which is described in detail below. Of course, as will be readily apparent to one of ordinary skill in the art to which the present invention pertains, switching devices other than triac switches may be used in controlling power flow from the power supply (not shown) through the electrical lines 21 to the guide vane actuator 14 in response to output control signals from the processor board 17.

The guide vane actuator 14 may be any device suitable for driving the guide vanes 12 toward either their open or closed position in response to electrical power signals received via electrical lines 21. For example, the guide vane actuator 14 may be an electric motor, such as a model MC-351 motor available from the Barber-Colman Company having a place of business in Rockford, Ill., for driving the guide vanes 12 toward either their open or closed position depending on which one of two triac switches on the system interface board 16 is actuated in response to control signals received by the triac switches from the processor board 17. The guide vane actuator 14 drives the guide vanes 12 toward either their fully open or fully closed position at a constant, fixed rate only during that portion of a selected base time interval during which the appropriate triac switch on the system interface board 16 is actuated. The effective overall rate of opening or closing of the guide vanes 12 is determined by the processor board repeatedly actuating and then deactuating the appropriate triac switch to provide a series of electrical pulses with a desired duty cycle to the guide vane actuator 14. For example, if a 35 second base time interval is selected, and it is desired to close the guide vanes 12 at an effective overall rate of 50% of the fixed, constant operating speed of the guide vanes 12, then the appropriate triac switch is repeatedly actuated and then deactuated to energize the guide vane actuator 14 for only 17.5 seconds of the 35 second base time interval. If it is desired to close the guide vanes 12 at an effective overall rate of 25% of the fixed, constant operating speed of the guide vanes 12 then the appropriate triac switch is repeatedly actuated and then deactuated to energize the guide vane actuator 14 for only 8.75 seconds of the 35 second base time interval. In a particular capacity control system 3, the base time interval is selected for compatibility with the operating capabilities of the guide vanes 12 and the guide vane actuator 14, and for providing a desired capacity control system 3 response characteristic to changes in operating conditions of the vapor compression refrigeration system 1.

Referring to FIG. 1, in operation, the processor board 17 of the capacity control system 3 receives electrical input signals from the temperature sensor 13, from the deadband switch 19, and from the set point and display board 18. The electrical signal from the temperature sensor 13 indicates the temperature of the heat transfer fluid in tubing 10 leaving the evaporator 5. The electrical signal from the set point and display board 18 indicates an operator selected, desired leaving heat transfer fluid temperature for the evaporator 5. The electrical signals from the deadband switch 19 is an operator selected setting for a desired deadband for the capacity control system 3. The deadband is a range of temperature about the selected evaporator leaving heat transfer fluid temperature in which it is desired not to actuate the capacity control system 3.

According to the present invention, the processor board 17 processes its electrical input signals according to preprogrammed procedures to determine if the sensed temperature of the heat transfer fluid leaving the evaporator 5 is less than the selected set point temperature by an amount which exceeds the lower limit of the selected temperature deadband. If the sensed temperature of the heat transfer fluid leaving the evaporator 5 is less than the lower limit of the selected temperature deadband, the processor board 17 generates control signals, for controlling the guide vane actuator 14, which are supplied from the processor board 17 to the triac switches on the system interface board 16. The control signals generated by the processor board 17 are a step function of the difference between the sensed temperature of the heat transfer fluid leaving the evaporator 5 and the selected set point temperature. The output control signals from the processor board 17 control the triac switches on the system interface board 16 to supply electrical power, as described previously, from the power supply (not shown) through the electrical lines 21 to the guide vane actuator 14. In this manner, the guide vane actuator 14 is energized to close the guide vanes 12 at an effective overall rate which is a function, preferably a step function, of the difference between the sensed temperature of the heat transfer fluid leaving the evaporator 5 and the desired set point temperature.

Figure 2:
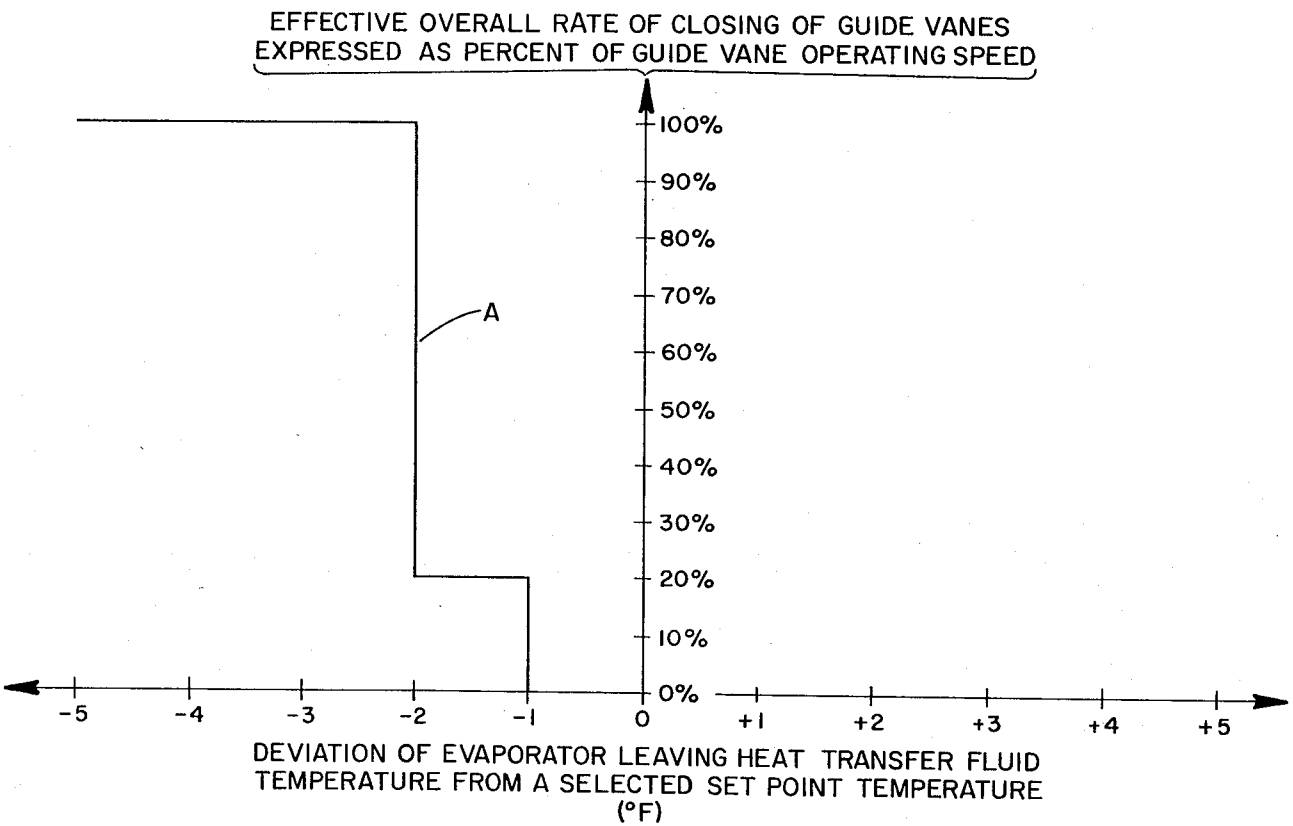
FIG. 2 is a graph illustrating the principles of operation of the control system shown in FIG. 1.

Referring to FIG. 2, purely illustrative examples are shown of the capacity control system 3 controlling the operation of the guide vanes 12 in the refrigeration system 1 in a stepwise manner according to the principles of the present invention. As shown in FIG. 2, the curve labeled "A" represents a hypothetical operating response curve for the guide vane 17 in the refrigeration system 1 as a function of the deviation, in degrees Fahrenheit, of evaporator 5 leaving heat transfer fluid temperature from a selected set point temperature. A lower limit of minus one degree Fahrenheit is shown for the selected temperature deadband about the set point temperature. The vertical axis of FIG. 2 is the effective overall rate of closing of the guide vanes 12 expressed as a percent of the constant, fixed guide vane operating speed. That is, the vertical axis of FIG. 2 shows the effective percent duty cycle of operation of the guide vane actuator 14 (and thus the guide vanes 12) as determined by the repeated actuation and then de-actuation of the appropriate triac switch on the system interface board 16 which is controlled by the processor board 17 as described previously.

As shown by the curved labeled "A" in FIG. 2, after the deviation of evaporator 5 leaving heat transfer fluid temperature from the selected set point temperature decreases below the minus one degree Fahrenheit lower limit of the selected temperature deadband, the guide vanes are driven toward their fully closed position at an effective overall rate which is approximately 20% of the constant, fixed guide vane operating speed. This allows the capacity control system 3 an opportunity to bring the temperature of the evaporator 5 leaving heat transfer fluid back to the selected set point temperature in a gradual, controlled manner which will prevent undesirable hunting by the capacity control system 3. However, as further shown by the curve labeled "A" in FIG. 2, if the deviation of evaporator 5 leaving heat transfer fluid temperature from the selected set point temperature decreases below a selected, second lower limit (minus two degrees Fahrenheit as shown in FIG. 2) the guide vanes 12 are driven toward their fully closed position at an effective overall rate which is 100% of the constant, fixed guide vane operating speed. This prevents undesirable freezing of the heat transfer fluid in the tubes 10 in the evaporator 5 of the refrigeration system 1 due to excessive cooling capacity operation of the refrigeration system 1.

Of course, the curve labeled "A" in FIG. 2 is an arbitrary curve selected to illustrate operation of the guide vanes 12 according to the principles of the present invention. In an actual refrigeration system 1 the lower limit of the temperature deadband, the temperature limit for switching from a relatively low effective overall rate of guide vane closing to a relatively high rate of guide vane closing, and the actual guide vane closing rates to be used, will all be selected based on a number of factors such as the freezing point of the heat transfer fluid being cooled by the evaporator 5, and the safety margin desired relative to preventing freezing of the heat transfer fluid in the tubes 10 of the evaporator 5.

Further, it should be noted that the foregoing description is directed to a particular embodiment of the present invention and various modifications and other embodiments of the present invention will be readily apparent to one of ordinary skill in the art to which the present invention pertains. Therefore, while the present invention has been described in conjunction with a particular embodiment, it is to be understood that various modifications and other embodiments of the present invention may be made without departing from the scope of the invention as described herein and as claimed in the appended claims.

What is claimed is:

1. A protective method of operating a refrigeration system having a microcomputer system for controlling the capacity of the refrigeration system to prevent freezing of a heat transfer fluid, which comprises the steps of:

generating a first signal indicative of a selected at point temperature for a heat transfer fluid cooled by operation of the refrigeration system;

sensing the temperature of the heat transfer fluid cooled by operation of the refrigeration system and generating a second signal indicative of this sensed temperature;

generating a third signal indicative of a lower limit of a selected temperature deadband relative to the selected set point temperature;

processing the first, second and third signals to determine the relative temperature difference between the sensed temperature and the selected set point temperature;

determining when the sensed temperature is less than the selected set point temperature by an amount which exceeds the lower limit of the selected temperature deadband;

generating a first control signal when it is determined the sensed temperature is less than the selected set point temperature by an amount exceeding the lower limit of the deadband; the first control signal being a step function of the relative temperature difference between the sensed temperature and the set point temperature;

then determining when the sensed temperature is less than the selected set point temperature by an amount which is greater than a second limit which exceeds the lower limit of the deadband;

generating a second step function control signal when the sensed temperature is less than the selected set point temperature by an amount greater than the second limit;

reducing the capacity of the refrigeration system at a relatively slow first effective overall rate in response to the generated first control signal, thereby to bring the sensed temperature back to the set point temperature at a gradual controlled rate; and rapidly reducing the refrigeration system capacity at a maximum second effective overall rate greater than the first rate in response to the generated second control signal to thereby prevent freezing of the heat transfer fluid.

2. A method of operating a refrigeration system as recited in claim 1 wherein the refrigeration system includes guide vanes for controlling refrigerant flow from an evaporator to a compressor of the refrigeration system and wherein the step of reducing comprises:

closing the guide vanes at a first effective overall rate when the first control signal is generated and closing the guide vanes at a second effective overall rate, greater than the first effective overall rate, when the second control signal is generated.

3. A protective control system for a refrigeration system having a microcomputer system for controlling the capacity of the refrigeration system to prevent freezing of a heat transfer fluid, said control system comprising:

means for generating a first signal indicative of a selected set point temperature for a heat transfer fluid cooled by operation of the refrigeration system;

means for sensing the temperature of the heat transfer fluid cooled by operation of the refrigeration system and for generating a second signal indicative of the sensed temperature;

means for generating a third signal indicative of a lower limit of a selected temperature deadband relative to the selected set point temperature;

means for processing the first, second and third signals to determine the relative temperature difference between the sensed temperature and the selected set point temperature;

first means for determining when the sensed temperature is less than the selected set point temperature by an amount which exceeds the lower limit of the selected temperature deadband, and for generating in response thereto a first control signal as a step function of the determined relative temperature difference between the second temperature and the set point temperature;

second means for determining when the sensed temperature is less than the selected set point temperature by an amount which exceeds a second limit which exceeds the lower limit of the selected temperature deadband, and for generating a second step function control signal in response thereto; and means for reducing the capacity of the refrigeration system at a relatively slow first effective overall rate in response to the generated first control signal, thereby to bring the sensed temperature back to the set point temperature at a gradual controlled rate;

said reducing means being capable of rapidly reducing the refrigeration system capacity at a maximum second effective overall rate greater than the first rate in response to the generated second control signal, thereby to prevent freezing of the heat transfer fluid.

4. A control system for a refrigeration system as recited in claim 3 wherein the refrigeration system includes guide vanes for controlling refrigerant flow from an evaporator to a compressor of the refrigeration system and wherein the means for reducing the capacity of the refrigeration system comprises:

a guide vane actuator for closing the guide vanes at a first effective overall rate when the first control signal is generated by the means for processing and for closing the guide vanes at a second effective overall rate, greater than the first effective overall rate, when the second control signal is generated by the means for processing.

* * * * *